United States Patent [19]

Colwell

[11] 4,127,908

[45] Dec. 5, 1978

[54] WATERBEDS

[75] Inventor: David J. Colwell, London, England

[73] Assignee: Keep View Ltd., London, England

[21] Appl. No.: 679,646

[22] Filed: Apr. 23, 1976

[30] Foreign Application Priority Data

Apr. 30, 1975 [GB] United Kingdom ..... 18082/75

[51] Int. Cl.[2] ..... A47C 27/08

[52] U.S. Cl. ..... 5/370; 5/60

[58] Field of Search ..... 5/370, 371, 60; 297/456, DIG. 2, 166, 179; 4/185 B

[56] References Cited

U.S. PATENT DOCUMENTS

| | | | |
|---|---|---|---|
| 1,512,068 | 10/1974 | Thornburg | 4/185 B |
| 2,828,489 | 4/1958 | Baku | 4/185 B |
| 3,266,061 | 8/1966 | Feuchsel | 5/60 |
| 3,585,356 | 6/1971 | Hall | 5/370 |
| 3,689,949 | 9/1972 | Weinstein | 5/370 |
| 3,746,835 | 7/1973 | Yu et al. | 5/370 |

*Primary Examiner*—Casmir A. Nunberg

*Attorney, Agent, or Firm*—Arthur A. March

[57] ABSTRACT

A flexible container for a waterbed of non-uniform depth with maximum depth at a location intermediate its ends and tapering away to minimum depths at and near said ends.

7 Claims, 4 Drawing Figures

WATERBEDS

This invention relates to waterbeds such as are used, for example, for patients in hospitals.

Waterbeds are, of course, well known and have long been in widespread use in cases in which it is desired, for medical or similar reasons, evenly to distribute the weight of a patient lying in bed. A waterbed as at present known and in common use, consists of a flexible hollow container which is filled with liquid (ordinarily water), and when so filled, presents a shape like that of an ordinary bed mattress i.e. is at least approximately rectangular in plan and of substantially uniform depth, the filled container being supported within a similarly shaped tray which provides support underneath and at the sides and ends.

The present invention seeks to provide an improved waterbed which, while offering substantially as good advantages in the way of comfort and weight distribution as a known waterbed, requires substantially less liquid to fill it and therefore be of substantially less weight than, a comparable known waterbed.

According to the present invention, there is provided a flexible container for a waterbed of non-uniform depth with maximum depth at a location intermediate its ends and tapering away to minimum depths at and near said ends.

According to another aspect of the present invention a tray adapted to support a correspondingly shaped and dimensioned liquid container of waterbed is made of non-uniform depth with maximum depth at a location intermediate its ends and tapering away to minimum depths at and near said ends.

Preferably the tray is of insulating material and is provided with heating means. The heating means may be incorporated or laminated into the material of the tray. The heating means may be constituted by a thin sheet or ribbon winding of a conductor.

Preferably the location where the depth is a maximum is at about 0.7 of the length of the tray from one end thereof.

Preferably also the location where the depth is a maximum extends across only a fraction - for example a centrally located half - of the full width of the tray, the depth tapering away to the corners of the tray from the ends of the line where the depth is a maximum.

According to a further aspect of the present invention, there is provided a flexible container and a supporting tray holding and supporting the container and shaped and dimensioned in correspondence therewith. Preferably there is provided a perimeter stiffener, for example of tubular form, to resist sideways thrust of the container when a person is lying thereon. The tray may be - and when the waterbed is for use in hospitals, usually will be - carried by a wheeled trolley.

Figure 1:
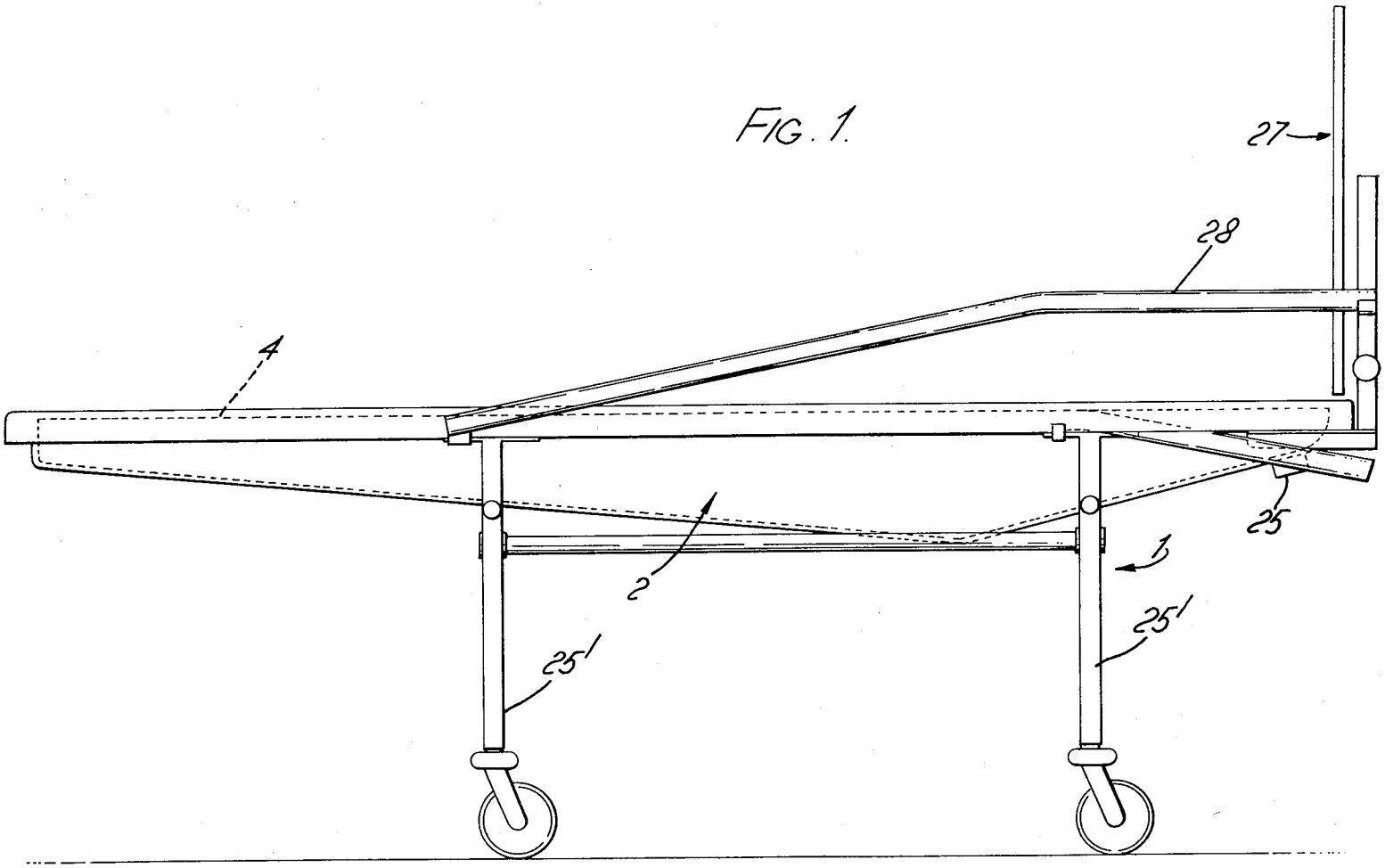
Figure 2:
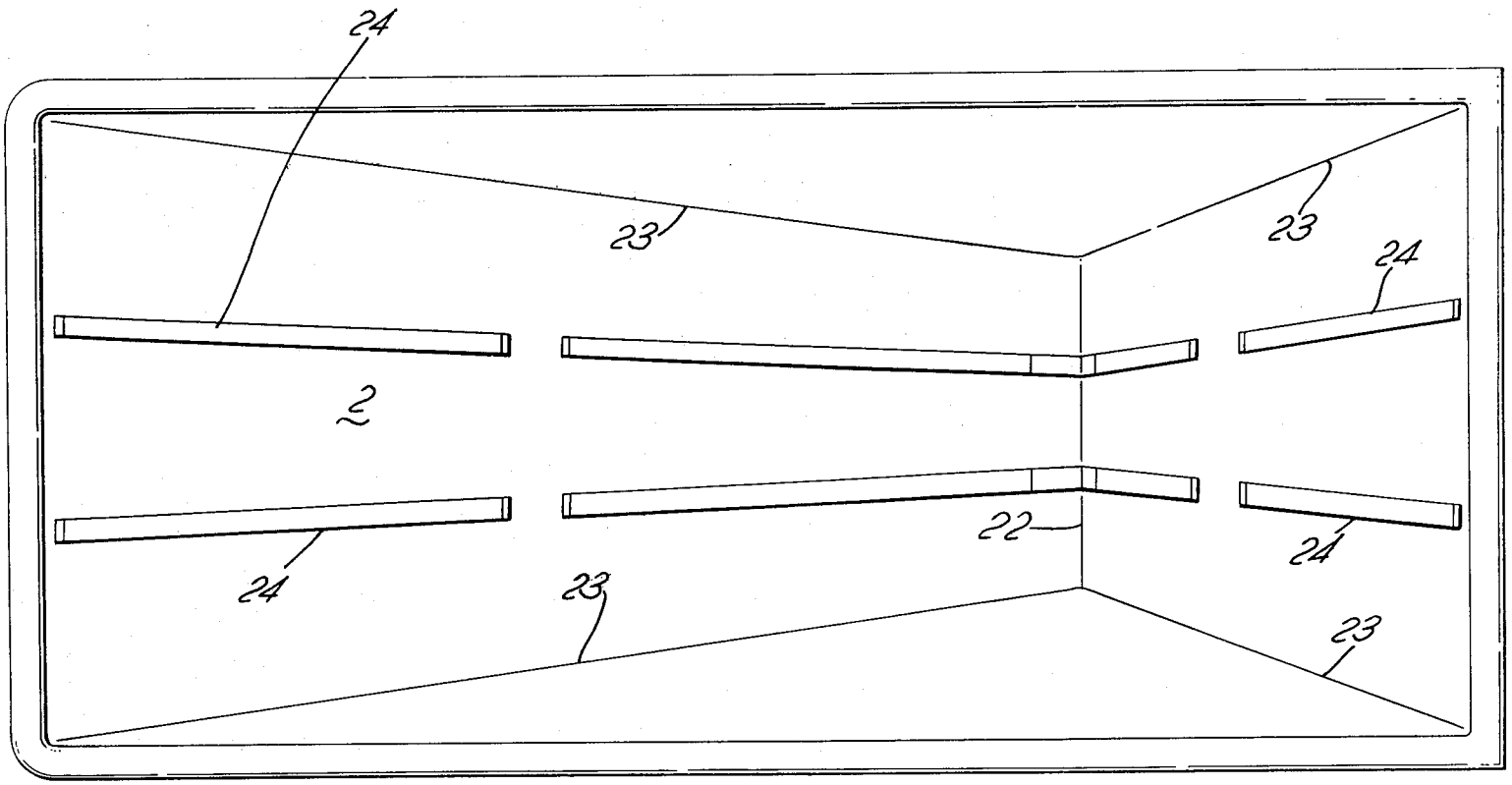
Figure 3:
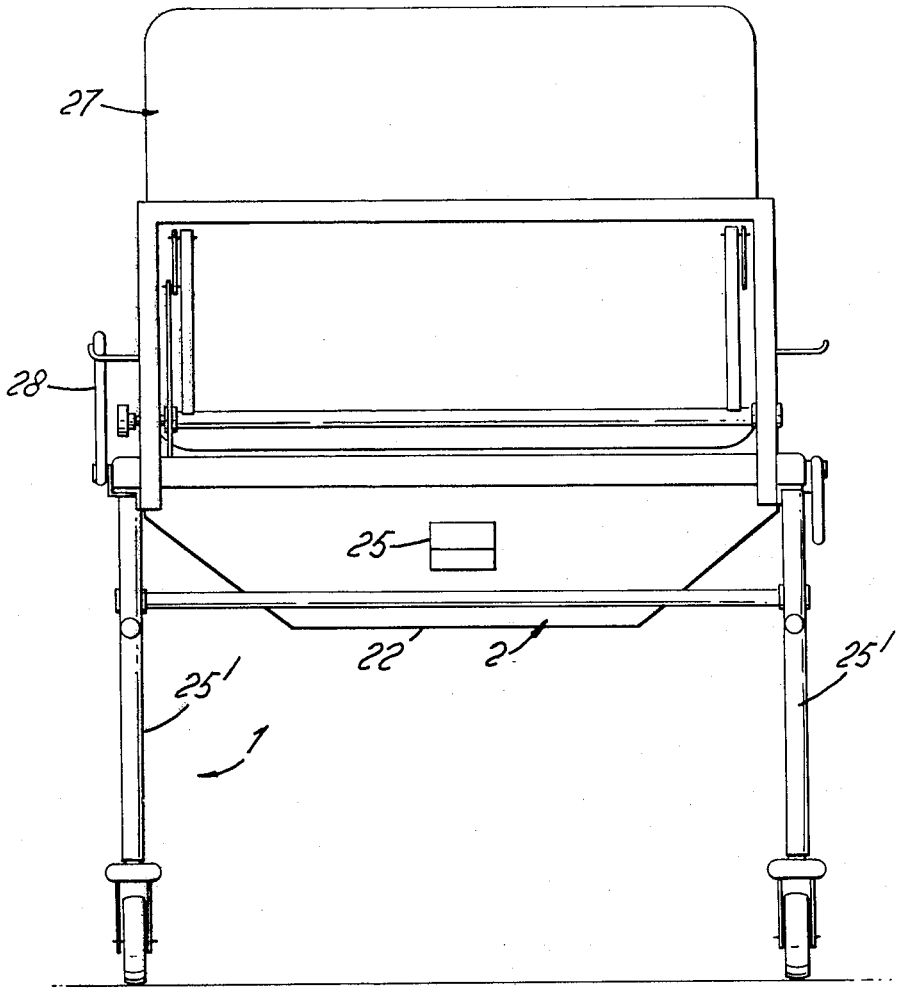
Figure 4:
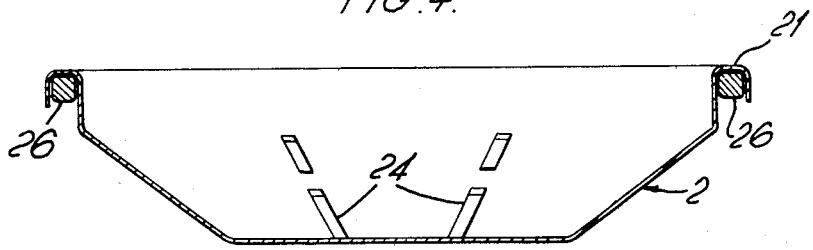

The invention is illustrated in the accompanying drawings, in which:

FIG. 1 is a side elevation of one embodiment of the invention showing a trolley supporting a tray which is shaped and dimensioned in correspondence with and is designed to accommodate, a flexible liquid container in accordance with the said invention, FIG. 2 is a plan view of the embodiment of FIG. 1, FIG. 3 is an end elevation of the embodiment of FIG. 1, and FIG. 4 is a section of the tray of FIG. 1 at the location of its maximum depeth.

Referring to the drawings, a wheeled trolley 1, of mainly either tubular construction or constructed from L-section members 26, supports a tray 2. The tray, which may be made of any convenient material, e.g. sheet steel or aluminium but is preferably fibre-glass, has a number of supporting members 21 formed thereon which are hooked over horizontal members in the trolley construction and thus support the tray therefrom. In contradistinction to known practice in waterbeds, the tray 2 is not of uniform depth. It is of maximum depth at the location 22 which, as viewed in FIG. 2, is a line extending over about one half the width W of the bed. It occurs at about 0.7 of the length of the bed from one end and about 0.3 of said length from the other. From the ends of the line 22 the depth of the tray tapers away linearly to a minumum depth at or near the four corners as indicated by the lines 23, in FIGS. 1 and 2. A perimeter stiffening member 3 resists sideways thrust of the liquid in a liquid filled container 4 in the tray when a patient is lying on it. It is to be understood that the container 4 is shaped and dimensionsed in correspondence with the shape and dimensions of the tray so that, when filled, it fits easily into the tray with its substantially flat top surface horizontal and in or near the plane of the top of the tray.

The tray 2 has strengthening ribs 24. The tray 2 is provided with heating means (not shown) controlled by a control box 25 on the tray. The heating means is in the form of an electrical heater preferably incorporated or laminated in the material of the tray and constituted by a thin sheet or ribbon winding of aluminium or other suitable conductor. This electrical heater may be near the tray surface but under that surface. It is possible, though not preferred to constitute the heater by a thin sheet or ribbon winding deposited on or stuck to the tray surface. The heater is preferably a relatively low voltage heater, e.g. 12 volts and, in a practical case, could have a wattage of about 200W.

The trolley 1 has an adjustable back rest 27 and support arms 28 as conventional on trolleys used in hospitals.

As will be appreciated, the volume and therefore the weight of liquid required to fill flexible hollow fillable envelope or the liquid container 4 of a waterbed in accordance with this invention is very substantially less than that required to fill a liquid container of a comparable known waterbed in which the said container is shaped like a mattress, i.e. has parallel horizontal upper and lower faces and vertical end and side walls.

Furthermore there is the advantage that the tray is of considerably increased strength and stiffness as compared with the simple flat container-supporting tray of a known comparable waterbed, for it consists in effect - and may, indeed, actually be made up of - a number of panels at angles to one another, so that there is greatly increased resistance to bending. This means that the tray may be of thinner material and be of less weight than that of a comparable known waterbed.

It will be observed that, in the illustrated embodiment, the trolley has four legs 25 which are not near the four corners of the tray - as is at present common practice - but are much nearer the centre of gravity of the whole structure, leaving a large overhang at the foot and a rather smaller one at the head. This too makes for increased tray strength and stiffness for a given weight since the tray length between the pairs of legs is about halved (compared with having legs at the corners), and, moreover, the weights of the cantilever-supported overhangs act in a downward direction and thus reduce the forces tending to produce bending of the tray.

Although the term "waterbed" has been used throughout this specification, it will be apparent that the invention is in no way dependent on the liquid actually used to fill the liquid container and the term "waterbed" is therefore used herein in a wide sense to include any bed with a flexible container whatever may be the liquid employed. Normally, of course, it will be water in the flexible container, but there may be cases in which, for some special reason, some other liquid or even a solid sink as sand or plaster is used as the filling.

I claim:

1. A waterbed comprising in combination an elongate tray having side walls sloping upwardly and outwardly from a position of maximum depth intermediately located nearer to one end than the other of the waterbed and being of non-uniform depth substantially throughout its extent, heating means associated with the tray for heating the waterbed, and an elongate flexible hollow water fillable envelope container shaped to fit correspondingly within and on the tray and having a substantially flat upper surface supportable on and by a selective volume of water correspondingly filling the container, the depth of which increases progressively from the periphery of the tray towards the position of maximum depth.

2. A waterbed according to claim 1 wherein the heating means is constituted by a thin sheet or ribbon winding of a conductor laminated into the material of the tray so as to provide a distribution of heat to the waterbed.

3. A waterbed according to claim 1 wherein the side walls of the tray are of triangular shape and the tray is provided with corresponding bottom walls extending downwardly and inwardly from the ends of the tray to the position of maximum depth, said walls correspondingly being joined to each other along their common extent.

4. A waterbed according to claim 1 wherein the periphery of the tray is provided with tray supporting means, and a corresponding peripheral tray supporting framework is provided for supportively engaging the tray supporting means.

5. A waterbed according to claim 4 wherein a wheeled trolley is provided having means for carrying the peripheral tray supporting framework at spaced apart locations substantially inwardly of the end portions of the peripheral tray supporting framework.

6. A waterbed according to claim 1 wherein an adjustable backrest is provided adjacent one end of the waterbed.

7. A waterbed according to claim 1 wherein the flexible water container is provided with a top surface which is flat, rectangular and corresponds substantially to the top surface dimensions of a conventional bed.

* * * * *